United States Patent [19]

Kochal

[11] Patent Number: 4,785,845

[45] Date of Patent: Nov. 22, 1988

[54] FAUCET MIXING BATTERY

[76] Inventor: Avraham Kochal, 4 Anna Frank St., Kfar Saba, Israel

[21] Appl. No.: 121,109

[22] Filed: Nov. 16, 1987

[30] Foreign Application Priority Data

Nov. 28, 1986 [IL] Israel ..... 80806

[51] Int. Cl.[4] ..... F16K 49/00

[52] U.S. Cl. ..... 137/341; 137/606; 4/192; 236/12.12

[58] Field of Search ..... 137/341, 606, 603; 4/192; 236/12.12

[56] References Cited

U.S. PATENT DOCUMENTS

| | | | |
|---|---|---|---|
| 3,721,386 | 3/1973 | Brick et al. | 236/12.12 |
| 4,077,545 | 3/1978 | Karls | 137/341 |
| 4,085,308 | 4/1978 | Youngquist | 137/341 |
| 4,429,422 | 2/1984 | Wareham | 4/192 |
| 4,528,709 | 7/1985 | Getz et al. | 236/12.12 |
| 4,648,426 | 3/1987 | Oberholtzer | 137/603 |
| 4,696,428 | 9/1987 | Shakalis | 236/12.12 |

*Primary Examiner*—A. Michael Chambers
*Attorney, Agent, or Firm*—Leonard Bloom

[57] ABSTRACT

A faucet mixing battery including a casing adapted to be fixed to a surface having hot and cold water outlets; first and second coupling ports carried by the casing, adapted to be coupled respectively to the outlets; a mixing spout extending from the casing; an electric water heating unit located in the casing and having a unit inlet coupled to at least the first coupling port and having a unit outlet coupled to the mixing spout; manual control means mounted on the casing for controlling the flow from the coupling ports to the mixing spout.

15 Claims, 4 Drawing Sheets

FAUCET MIXING BATTERY

FIELD OF THE INVENTION

This invention relates to a faucet mixing battery.

BACKGROUND OF THE INVENTION

Known faucet mixing batteries are adapted to be fixed to a surface such as, for example, a wall, or a sink frame which is provided with hot and cold water outlets. The battery is provided with means for coupling these outlets to a mixing spout and is furthermore provided with manual control means for controlling the respective flow of the water from the hot and cold water outlets to the mixing spout.

It is known to associate an electric water heating unit with such batteries so that upon actuation of the heating unit a heated water supply can be obtained. This known association has, in the past, taken two main forms. In a first form, the main water supply continues to reach the mixing spout from the outlets but a portion thereof is diverted from one or other of the outlets so as to pass through an electric water heating unit, the latter being provided with an auxiliary spout. With this arrangement, the water emerging from the main mixing spout is wholly unaffected by the electric water heating unit and heated water can be obtained by actuation of the electric heating unit, the heated water emerging from the auxiliary spout.

In a second form, the entire water supply from one outlet is diverted through an electric water heating unit, located separately from the battery, and the output from the unit passes into the battery so as to emerge from the mixing spout.

SUMMARY OF THE INVENTION

It is an object of the present invention to provide a new and improved faucet mixing batery with an integrally located electric water heating unit, which battery can directly replace existing batteries so as to be capable of direct coupling to existing water outlets.

According to the present invention there is provided a faucet mixing battery comprising a casing adapted to be fixed to a surface having hot and cold water outlets;

first and second coupling ports carried by said casing, adapted to be coupled respectively to said outlets;

a mixing spout extending from said casing;

an electric water heating unit located in said casing and having a unit inlet coupled to at least said first coupling port and having a unit outlet coupled to said mixing spout;

manual control means mounted on said casing for controlling the flow from said coupling ports to said mixing spout.

Thus, such a faucet mixing battery, in accordance with the invention, can be used as a simple and direct replacement for an existing faucet mixing battery merely by removing the latter and fitting in its place the new battery, provision of course being made for coupling the electric water heating unit to an electric supply. Therefore, by virtue of the use of the novel faucet mixing battery, there can be avoided the various plumbing operations required for installing an electric water heating unit in accordance with the known arrangements.

BRIEF DESCRIPTION OF THE DRAWINGS

Several embodiments of faucet mixing batteries in accordance with the present invention will now be described by way of example and with reference to the accompanying drawings, in which.

DETAILED DESCRIPTION OF THE INVENTION

Figure 1:
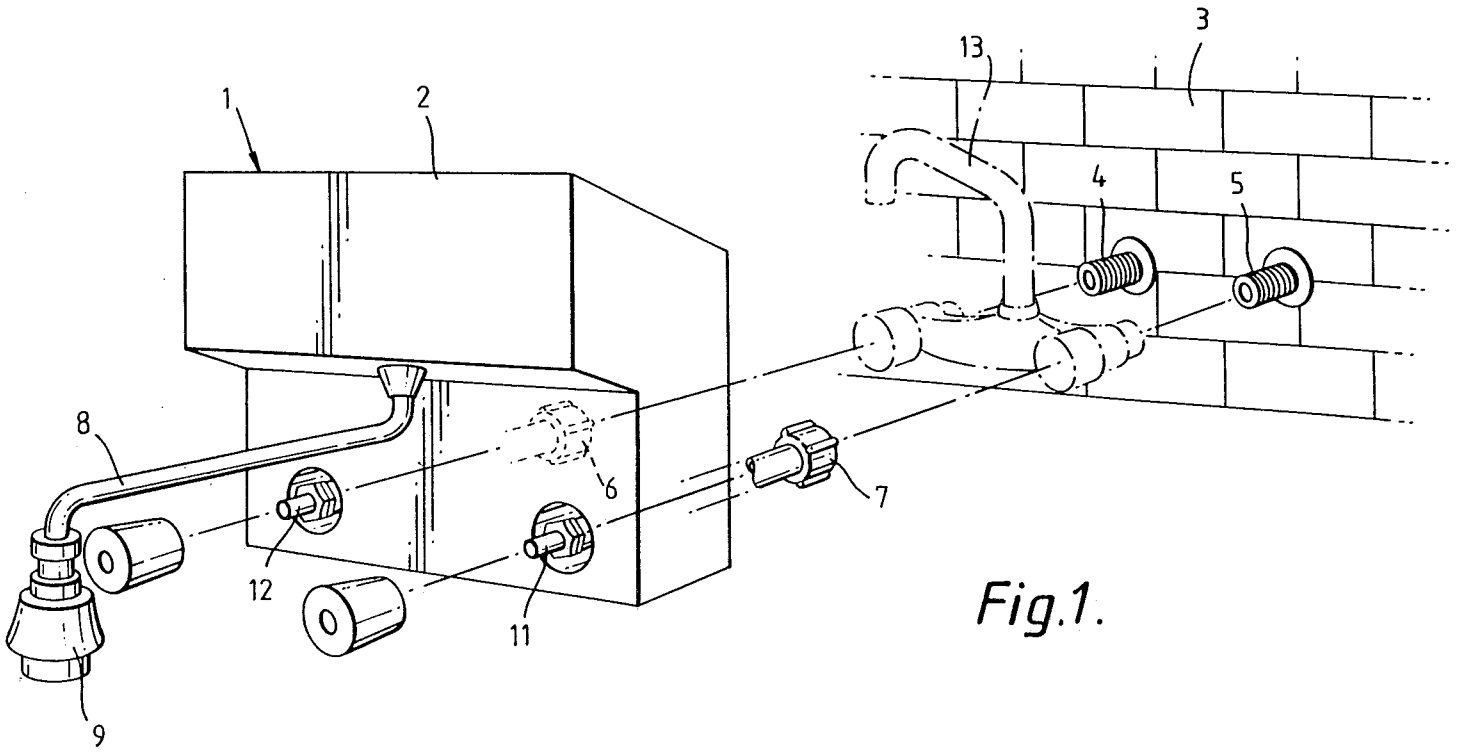
FIG. 1 is a perspective view of a mixing batery according to one embodiment of the invention about to be mounted on a wall surface in replacement for an existing conventional mixing battery.
Figure 2:
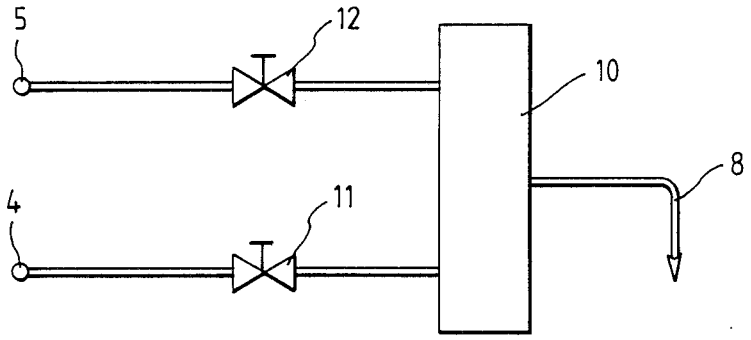
FIG. 2 is a schematic water flow diagram illustrating the flow of water through the battery of FIG. 1.

Referring to FIGS. 1 and 2, there is shown a faucet mixing battery 1 constructed and operative in accordance with one embodiment of the present invention. Mixing battery 1 comprises a casing 2 which is adapted to be fited to a wall surface 3 having outlets 4 and 5 which can be coupled to respective hot and cold water supplies. The casing is provided with coupling ports 6 and 7 which are arranged to be coupled respectively to the outlets 4 and 5. The casing is furthermore provided with a mixing spout 8 extending from the casing. The mixing spout 8 terminates in an adjustable nozzle 9 such that the water flow rate therethrough can be adjusted.

Located within the casing is an electric water heating unit shown schematically in FIG. 2 of the drawings. As seen in this Figure, the water outlets 4 and 5 are coupled via respective manual control means 11 and 12 with an inlet of the water heating unit 10, an outlet of which is coupled to the mixing spout 8. The electric water heater unit is provided with means (not shown) for coupling it to an electricity supply and is also provided with an appropriate manually operated on/off switch (not shown), a pressure controlled switch (not shown) and a thermostatic control (not shown).

In use, the mixing battery 1 is to be fitted to a wall surface 3 so as to replace an existing mixing battery 13. For this purpose, the battery 13 is simply removed and in its place the ports 6 and 7 are coupled to the outlets 4 and 5. The casing itself is fixed to the wall and the electric water heating unit 6 is connected to an electricity supply. Upon actuation of the electric water heating unit by the manually operated switch and the opening of one or both of the manual control means 11 and 12, water passes through the water heating unit and the flow actuates the pressure controlled switch which switches on the unit so that the water is heated and emerges from the spout 8.

In order to facilitate a rapid heating of the water, the adjustable nozzle 9 is adjusted so as to reduce the outflow rate. Reduction of the outflow rate serves two purposes. First, as the outflow volume is decreased correspondingly, the water pressure increases sufficiently to cause the pressure controlled switch to actuate the heating unit. Second, it insures that the the outflow of water via the heating unit is sufficiently slow so as to permit it to be heated to a relatively high temperature before it flows out through the spout 8.

Where the outlet 4 is connected to a hot water supply of sufficiently high temperature, the opening of the manual control means 12 and the consequent passage of hot water through the switched-on unit only results in the actuation of the heating element in unit 10 when the temperature of the hot water falls below a certain minimum temperature, whereupon the thermostatic control actuates the unit.

Where it is desired to ensure a cold water supply, the heating unit is switched off. Alternatively, the cold water supply from the outlet 5 can be arranged to bypass the unit 10.

Figure 3:
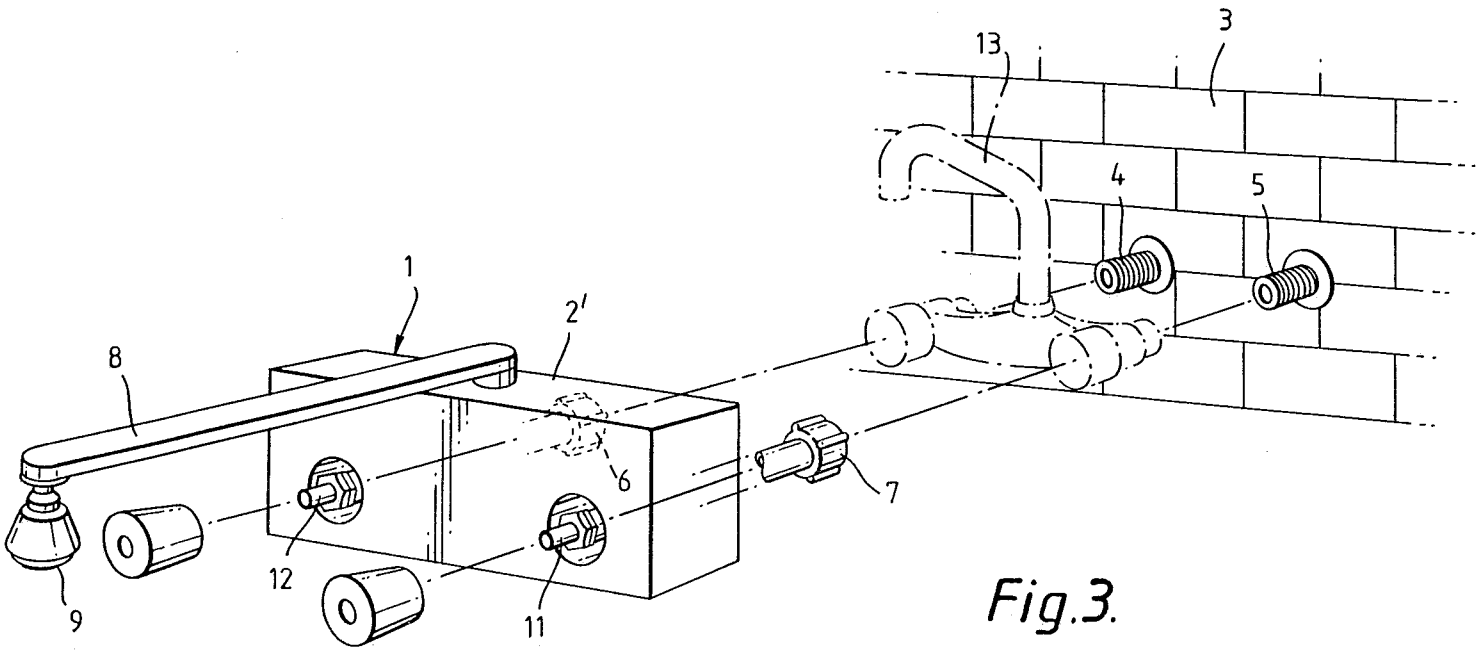
FIG. 3 is a perspective view of a mixing battery according to an alternate embodiment of the present invention.

An alternate embodiment of the invention is shown in FIG. 3. The mixing battery of FIG. 3 is substantially identical to that of FIG. 1 with the exception that casing 2' is more compact than casing 2. Thus, the embodiment of FIG. 3 requires less space on the wall on which it is to be mounted and is more attractive to the eye.

While in the arrangements described above separate manual control means are provided for the hot and cold water supply, such separate means can be readily replaced by known unitary control means. An example of a mixing batery according to the present invention having a single control means is shown in FIG. 4.

Figure 5:
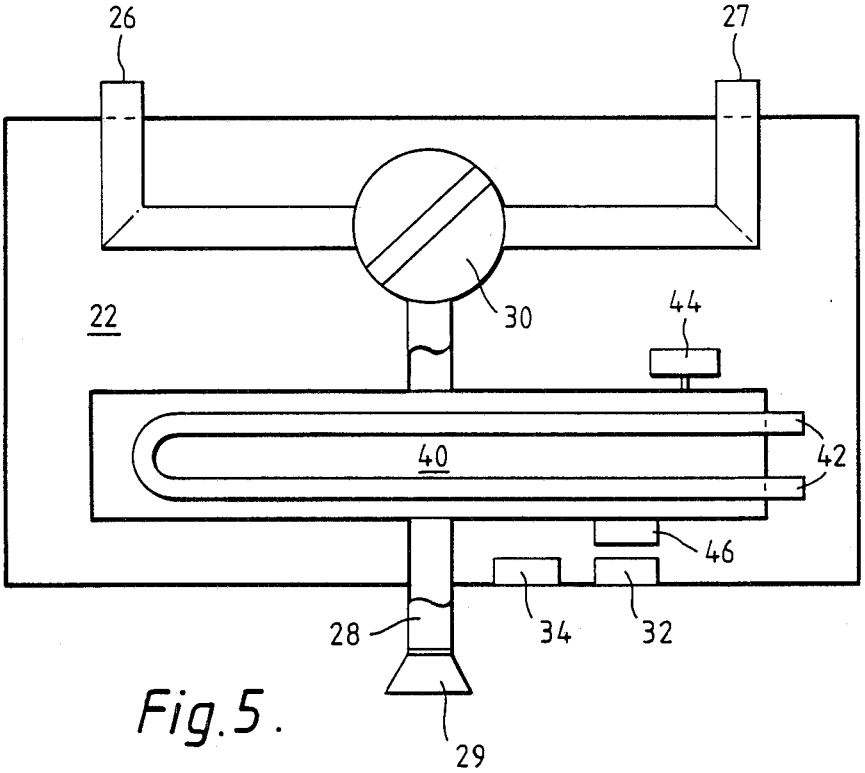
FIG. 5 is a schematic illustration of a heating unit according to the invention suitable for use in the battery of FIG. 4.
Figure 4:
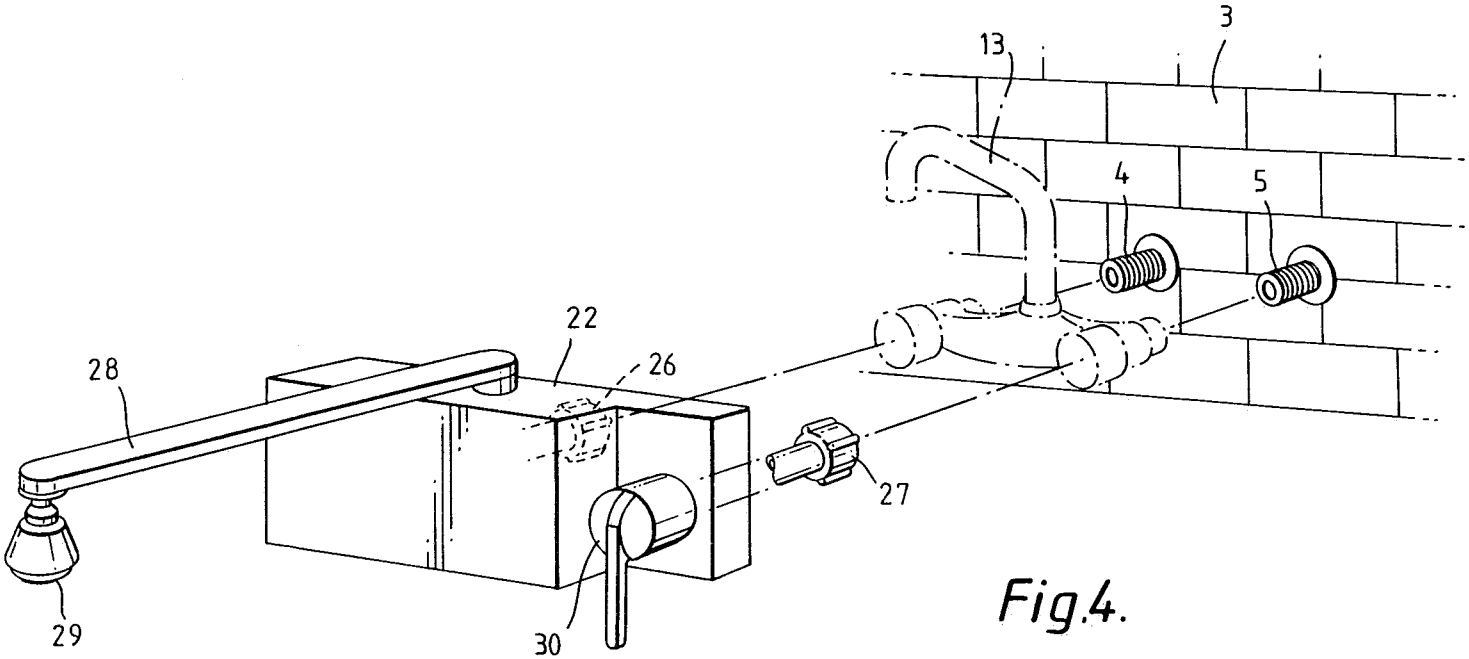
FIG. 4 is a perspective view of a mixing battery according to another alternate embodiment of the present invention.

The mixing battery of FIGS. 4 and 5 comprises a compact casing 22 which is adapted to be fitted to a wall surface 3 having outlets 4 and 5 which are coupled to respective hot and cold water supplies. The casing is provided with coupling ports 26 and 27 which are arranged to be coupled respectively to the outlets 4 and 5. The casing is furthermore provided with a mixing spout 28 extending from the casing. The mixing spout 28 preferably terminates in an adjustable nozzle 29 such that the water flow rate therethrough can be adjusted.

A single manual control means 30 is provided in casing 22. Any conventional control means permitting selectable flow of cold or hot water by rotation or lifting of the handle is operative in the present invention. Control means 30 is coupled to the hot and cold water ports 26 and 27. A manually operated on/off switch 32 is provided in casing 22, preferably together with an electric light 34 or other indicator means to indicate when the heating unit is in operation.

Located within the casing is an electric water heating unit generally designated 40 shown schematically in FIG. 5 of the drawing. As seen in this Figure, the electric water heater unit comprises a heating element 42, a pressure controlled switch 44, a thermostatic control 46, and means (not shown) for coupling it to an electricity supply.

The water outlets 4 and 5 are coupled via manual control means 30 with an inlet of the water heating element 42, an outlet of the unit being coupled to mixing spout 28. It will be appreciated that at least one of the coupling ports 26 and 27 is coupled to the inlet of the water heating element.

Operation of this embodiment is as follows. When it is desired to operate the mixing battery in its normal mode, nozzle 29 is adjusted to permit normal water flow through spout 28. Actuation of manual control means 30 causes the mix of hot and cold water directly from ports 26 and 27, as in conventional mixing batteries.

When hot water is required, nozzle 29 is rotated to produce a slower water flow rate and on/off switch 32 is actuated, causing the indicator light 34 to light up. The resulting increased water pressure causes pressure controlled switch 44 to activate the heating element 42 past which the water flows. The slow flow rate permits the water to be heated to a relatively high temperature before emerging from spout 28. Should the water temperature go too high, either due to overheating by the heating element or due to pre-heating as from a solar heater, thermostatic control 34 will switch off heating element 42 until the water temperature falls below a predetermined threshold.

According to a preferred embodiment of the invention, both of the coupling ports 26 and 27 are coupled via the water heating unit to spout 28, either by way of two manual control means or a single control element. Thus, water from either or both ports will pass through the unit when the manual controls are operated. This water will be heated if the unit is on, and will pass unchanged if the unit is off.

In the case where there is only a single port in a wall, that port can be connected via the heating unit to produce heated water as desired, whether the single port is coupled to a hot or cold water supply. Alternatively, only one of two ports may be connected via the heating unit to the spout, the other leading directly to the spout. In this case, either the hot or cold water port may be coupled to the heating unit, the hot water port being preferred in order to save energy where a solar heater is also provided.

It will be appreciated that the invention is not limited to what has been shown and described hereinabove by way of example. Rather, the scope of the invention is limited solely by the claims which follow.

I claim:

1. A self-contained faucet mixing battery adapted to be secured to respective existing hot and cold water outlets of a water flow path, in combination comprising:

a casing adapted to be fixed to a surface having the existing hot and cold water outlets of the water flow path;

first and second coupling ports carried by said casing adapted to be coupled, respectively, to said existing hot and cold water outlets of the water flow path, such that water flowing from said existing outlets is received by, the respective coupling ports and passes therethrough being directly received in the casing;

a mixing spout directly secured to, carried by and extending from said casing;

an electric water heating unit located entirely within said casing and having a unit inlet coupled to at least one of said coupling ports and having a unit outlet coupled to said mixing spout; and manual control means mounted on and carried by said casing for controlling the flow of water received in the casing from said coupling ports to said mixing spout such that the mixing spout selectively provides hot and/or cold water even when the water flowing from the existing outlets is cold.

2. A mixing battery according to claim 1, wherein both of said coupling ports are coupled to said unit inlet.

3. A mixing batery according to claim 2, and wherein said mixing spout is fitted with an adjustable nozzle for adjustment of waterflow therethrough.

4. A faucet mixing battery according to claim 2 and wherein said manual control means comprises two separate control means, one each for hot and cold water.

5. A faucet mixing battery according to claim 2 and wherein said manual control means comprises a single unitary control means for both hot and cold water.

6. A faucet mixing battery as claimed in claim 2, and wherein said electric water heating unit further comprises pressure controlled activation means and a thermostatic control means.

7. A mixing battery according to claim 1, and wherein said mixing spout is fitted with an adjustable nozzle for adjustment of waterflow therethrough.

8. A faucet mixing battery according to claim 7 and wherein said manual control means comprises two separate control means, one each for hot and cold water.

9. A faucet mixing battery according to claim 7 and wherein said manual control means comprises a single unitary control means for both hot and cold water.

10. A faucet mixing battery as claimed in claim 7, and wherein said electric water heating unit further comprises pressure controlled activation means and a thermostatic control means.

11. A faucet mixing battery according to claim 1 and wherein said manual control means comprises two separate control means, one each for hot and cold water.

12. A faucet mixing battery according to claim 1 and wherein said manual control means comprises a single unitary control means for both hot and cold water.

13. A faucet mixing battery as claimed in claim 1, and wherein said electric water heating unit further comprises pressure controlled activation means and a thermostatic control means.

14. A self-contained faucet mixing battery adapted to be secured to at least one existing outlet of a water flow path, in combination, comprising:

a casing adapted to be fixed to a surface having the existing water outlet of the water flow path;

at least one coupling port carried by said casing adapted to be coupled to a respective existing water outlet of the water flow path, such that water flowing from said existing outlet is received by the respective coupling port coupled thereto and passes therethrough being directly received in the casing;

a mixing spout directly secured to, carried by and extending from said casing;

an electric water heating unit located entirely within said casing and having a unit inlet coupled to at least the one of said coupling port and having a unit outlet coupled to said mixing spout; and manual control means mounted on and carried by said casing for controlling the flow of water received in the casing from said coupling port to said mixing spout, such that the mixing spout selectively provides hot and/or cold water even when the water flowing from the existing outlets is cold.

15. A self-contained faucet mixing battery adapted to be secured to at least one existing outlet of a water flow path, in combination, comprising:

a casing adapted to be fixed to a surface having the existing water outlet of the water flow path;

at least one coupling port carried by said casing adapted to be coupled to a respective existing water outlet of the water flow path;

a mixing spout extending from said casing, such that the water flow path exists therefrom at an outflow rate;

an electric water heating unit located within said casing and having a unit inlet coupled to at least one of said coupling ports and having a unit outlet coupled to said mixing spout, such that the water flow path passes therethrough, said flow path having a water pressure;

an adjustable nozzle disposed on the mixing spout for adjusting the flow of water therethrough, such that the outflow rate thereof is reduced and the water pressure in the electric water heating unit is increased;

a pressure controlled activation means for activating the electric water heating unit in response to an increase in the water pressure in the said heating unit, such that adjustment of the nozzle for reducing the flow of water therethrough increases the water pressure in the heating unit wherein the said activation means automatically activates the electric water heater; and manual control means mounted on said casing for controlling flow from said coupling ports to said mixing spout.

* * * * *